US005494166A

United States Patent [19]

Kuwata et al.

[11] Patent Number: 5,494,166

[45] Date of Patent: Feb. 27, 1996

[54] CONTAINER FOR HOLDING ELONGATED ARTICLE

[75] Inventors: Tatsuo Kuwata, Mino; Terumi Matsuda, Nishinomiya; Yoshio Washizu, Takatsuki, all of Japan

[73] Assignee: Takeda Chemical Industries, Ltd., Osaka, Japan

[21] Appl. No.: 321,871

[22] Filed: Oct. 14, 1994

[30] Foreign Application Priority Data

Oct. 15, 1993 [JP] Japan ..... 5-062475 U
Oct. 15, 1993 [JP] Japan ..... 5-291129

[51] Int. Cl.[6] ..... B65D 5/08; B65D 85/42

[52] U.S. Cl. ..... 206/528; 206/443; 206/485

[58] Field of Search ..... 206/528, 530, 206/443, 446, 485

[56] References Cited

U.S. PATENT DOCUMENTS

| | | | |
|---|---|---|---|
| 2,620,962 | 12/1952 | Powell | 206/485 |
| 3,009,622 | 11/1961 | Leone | 206/485 |
| 4,832,199 | 5/1989 | Rigby | 206/485 |
| 5,361,907 | 11/1994 | Mohrhauser | 206/528 |

FOREIGN PATENT DOCUMENTS

| | | |
|---|---|---|
| 988794 | 5/1951 | France . |
| 2219661 | 9/1974 | France . |
| 1486477 | 3/1972 | Germany . |
| 2453309 | 5/1976 | Germany . |

*Primary Examiner*—Jacob K. Ackun
*Attorney, Agent, or Firm*—Wenderoth, Lind & Ponack

[57] ABSTRACT

A top wall for closing an upper opening of a rectangular frame is formed continuously with an upper edge of a side wall disposed on one side of a row consisting of four side walls. An upper flap having a supporting wall is folded to form one article supporting section on an upper edge of a side wall adjacent to the side wall. A lower flap to which a bonding portion continuous with the upper flap is fixed is formed continuously with the lower edge of the side wall. An upper flap is formed continuously with an upper edge of a side wall disposed on the other side of the row and has a shorter supporting wall. The upper flap is folded to form another article supporting section opposed to the one article supporting section. A lower flap is formed continuously with a lower edge of the side wall. A bonding portion continuous with the supporting wall is bonded to the lower flap. At least one supporting window is defined on each of upper supporting portions and each of the supporting walls.

25 Claims, 11 Drawing Sheets

CONTAINER FOR HOLDING ELONGATED ARTICLE

BACKGROUND OF THE INVENTION

1. Field of the Invention

The present invention relates to a container for holding an elongated article, with both ends thereof supported in the container. The container is formed by folding a sheet and bonding predetermined portions thereof to each other. More particularly, the present invention relates to a container for supporting a cylindrical disposable type syringe, such as dual chamber prefilled syringe containing medicine and comprising a needle disposed at one end thereof and a finger grip projecting from the other end of the body thereof, without the syringe being rotated unexpectedly. Further, during the transport of the containers, they can be easily overlaid one on the other and reliably stored so that syringes can be removed therefrom easily.

2. Description of the Prior Art

In a container for stably supporting an elongated article such as a disposable type syringe hitherto known, a supporting base prepared separately from the container is placed in the container.

A packing container is, however, delivered to customers with the container and the supporting base combined with each other in the manufacturing process. Thus, the assembly process is complicated and further, it is expensive to transport and store the container. In addition, in this type of container, an article accommodated in the container is unstable in the lengthwise direction thereof although it can withstand vibrations which occur in the widthwise direction thereof. Hence, the article cannot be supported stably in the container.

Therefore, there is a growing demand for a container which has an integral base section and can be folded from a sheet to a three dimensional state for supporting articles in such a manner that the base section supports an article and the container can be transported and stored conveniently.

In order to comply with the demand, the present applicant proposed folding type containers for supporting vials or ampuls as disclosed in Japanese Laid-Open Utility Model Publications No. 6-25115, 6-27542, and 6-14022.

Referring to FIG. 10, the above-described containers have supporting sections 100 and 101 integral with other portions of the container and opposed to each other, and apertures (or supporting windows) 102 and 103 respectively formed on the supporting sections 100 and 101.

The which support windows 102 and 103 supporting a disposable type syringe as shown in FIG. 11 have the following problems.

That is, referring to FIG. 12, in this kind of disposable type syringe (D), a wing-shaped finger grip (E) is formed at the rear end of the cylindrical body 200 thereof. The finger grip (E) comprises a cylindrical portion 201 into which the body 200 is inserted and a rectangular flat portion 202 disposed at the rear end of the cylindrical portion 201. The size of the shorter side 202*a* of the flat portion 202 is almost equal to the diameter (F) of the cylindrical portion 201 while the size of the long side 202*b* thereof is greater than the diameter (F) (see FIG. 11). The flat portion 202 is perpendicular to the body 200 and projects upwardly and downwardly from the body 200.

When the syringe (D) is inserted into the window 102 with the longer side 202*b* of the finger grip (E) vertical, as shown in FIG. 11, there is a possibility that the flat portion 202 will turn downwardly due to an unexpected rotation of the cylindrical body 200 of the syringe (D). As a result, the finger grip (E) is disposed under an upper supporting portion 100*a* of the supporting section 100. That is, the longer side 202*b* becomes horizontal as shown in FIG. 13. As a result, the finger grip (E) is caught by the upper supporting strip 100*a* when the syringe (D) is removed from the container. Thus, the syringe (D) cannot be removed from the container easily.

The conventional container shown in FIG. 10 is used to support ampules and vials. Thus, the length of the supporting portion is small. It is necessary to lengthen the supporting portion of the container for containing disposable type syringes having a finger grip formed at the rear end thereof. There is a demand for the development of a container which can be made flat before syringes are put into the container and then shaped to be three-dimensional with one touch when the syringes are put into the container. However, it is very difficult to make the container three-dimensional with one touch when the long supporting section having the long supporting windows formed thereon is folded and bonded to a bottom wall.

SUMMARY OF THE INVENTION

The present invention has been developed with a view to substantially solving the above described disadvantages and has for its essential object to provide an improved container which prevents syringes from being rotated unexpectedly so that the syringe can be removed easily therefrom.

It is another object of the present invention to provide a container made of a sheet which can be formed into a three-dimensional state by folding a long supporting section with one touch.

In order to achieve the aforementioned object, according to a first invention, there is provided a container for holding elongated articles, assembled by folding a sheet and bonding necessary portions to each other, comprising: a row which comprises four side walls continuous with each other via three fold lines spaced at required intervals, both ends of which are bonded to each other to form a rectangular frame; a bottom wall which continues with a lower edge of at least one of the side walls via at least one fold line and closes a lower opening of the rectangular frame; an upper flap which continues with an upper edge of the side wall via a fold line, has a supporting window and is folded into the rectangular frame to form a first article supporting section; and an upper flap which continues, via a fold line, with an upper edge of the side wall disposed on the other side of the row, has a supporting window and is folded into the rectangular frame to form a second article supporting section lower than the first article supporting section. In this construction, the supporting window of the first article supporting section and the supporting window of the second article supporting section are opposed to each other so that the article is supported, with both sides thereof in the lengthwise direction thereof inserted into both supporting windows.

In another aspect of the present invention, similarly to the first invention, according to a second invention, there is provided a container for holding an elongated article, assembled by folding a sheet and bonding necessary portions to each other; and the first article supporting section and the second article supporting section are opposed to each other in the container, and the supporting window of the first article supporting section and the supporting window of the second article supporting section are opposed to each other so that the article is supported, with both sides thereof in the lengthwise direction thereof inserted into both supporting windows. The container according to the second invention has bottom walls and lower flaps so as to allow for assembly of a sheet into a three-dimensional state by folding it and bonding necessary portions to each other. That is, the container comprises a first bottom wall which continues with a lower edge of a first side wall disposed on one side of the row via a fold line, has an engaging portion defined at a lower edge thereof and a connecting portion defined at a side thereof via an inclined fold line, and closes one half of the lower opening of the rectangular frame; a first lower flap which continues with a lower edge of a second side wall adjacent to the first side wall via a fold line and has an aperture defined on one side thereof, the other side of which is connected with the folded connecting portion with adhesive agent; a second bottom wall which continues with a lower edge of a third side wall adjacent to the second side wall via a fold line, has a locking portion defined at a tip edge thereof so that the locking portion is connected with the engaging portion of the first bottom wall in engagement therewith and has a connecting portion defined at a side thereof via an inclined fold line, a corner defined on the other side is inserted into the above said aperture to close the other half of the lower opening of the rectangular frame; and a second lower flap which continues with a lower edge of a fourth side wall adjacent to the third side wall via a fold line and has a slit, defined thereon, into which an edge of the first bottom wall is inserted. One side of the second lower flap is connected with the connecting portion of the second bottom wall with adhesive agent. The bottom of the container can be formed of the first and second bottom walls and the first and second lower flaps easily and reliably.

The height of the second article supporting section may be set to be greater than that of the first article supporting section.

In the container according to the first and second invention, the first and second article supporting sections opposed to each other comprises an upper supporting portion extending horizontally on the inner sides of the second and fourth side walls; a supporting wall extending vertically, thus connecting the inner end of the upper supporting portion and each of the first and second lower flap with each other; a bonding portion continuous with the supporting wall and being fixed to each of the first and second lower flaps with adhesive agent.

The supporting window is defined on the supporting wall and the upper supporting portion.

Preferably, a holding projection is formed on the supporting window. Preferably, the supporting window comprises a plurality of supporting windows spaced from each other in parallel with each other at regular intervals to accommodate a plurality of articles.

Preferably, the length of the first article supporting section opposed to the second article supporting section in the container is greater than that of the second article supporting section such that the leading end of the first article supporting section is disposed at approximately the center of the container.

The vertical length of the upper supporting portion of the second article supporting section is shorter than that of the fourth side wall; and the upper supporting portion is stepped on the fourth side wall. Five fold lines parallel with the fold line corresponding to the upper edge of the fourth side wall are formed at required intervals on the second upper flap forming the second article supporting section. The second article supporting section thus formed is stepped and lower than the height of the side walls and that of the first article supporting section.

According to the third invention, in order to hold the second article supporting section tightly, a container comprising a double wall is provided. That is, the first upper flap comprises the supporting wall having the supporting window formed thereon and the upper supporting portion are continuously formed on an inner side of an outer surface of the rectangular frame having an entrance/exit formed thereon, by folding the fourth side wall in a direction from the upper end thereof.

The container according to the present invention is suitable for accommodating and holding a disposable type syringe such as dual chamber prefilled syringe having a finger grip at one end thereof. That is, the finger grip comprises a cylindrical portion into which the syringe is inserted and a flat portion projecting from one end of the cylindrical portion. The shorter side of the flat portion is substantially the same as the diameter of the syringe and the longer side thereof is greater than diameter of the syringe. The finger grip is inserted into the supporting window of the second article supporting section, with the longer side of the flat portion disposed vertically and the upper end thereof projecting from the supporting window. To this end, the height of the supporting window of the second supporting section is set to be approximately the half of the length of the longer side of the flat portion of the finger grip. Further, the width of the supporting window is set to be greater than that of the shorter side of the flat portion of the finger grip and smaller than that of the longer side thereof. In this manner, the syringe can be prevented from being turned down.

The container according to the first invention is assembled as follows: First, the first and second upper flaps are folded along fold lines. The lower flaps corresponding to the upper flaps are folded along each of the lower edges of the side walls and overlaid on each of the supporting walls, and the bonding portion continuous with each supporting wall is bonded to each lower flap with adhesive agent.

Then, the row is folded along the fold line disposed between the first side wall and the second side wall and the fold line disposed between the third side wall and the fourth side wall, and the connecting portion of the first side wall is bonded to one end of the fourth side wall with adhesive agent. Then, the sheet is folded double along the fold line disposed between the second side wall and the third side wall to overlay the one half on the other half. In this manner, the sheet is in a temporary assembled state. In storing and transporting the sheet, it is folded flat.

In order to form the sheet into the three-dimensional container, first, the four side walls are located to be perpendicular to each other. Then, the first and second lower flaps are overlaid on each of the first and second article supporting sections in such a position that the first and second lower flaps form a right angle with each of the second side wall and the fourth side wall. As a result, the supporting walls connected with each of the first and second lower flaps become perpendicular to each of the first and second lower flaps. Consequently, the supporting walls and the upper supporting portion continuous with each of the supporting walls form a pair of the first and second article supporting sections such that the first and second article supporting sections are opposed to each other inside the three-dimensional rectangular container. In this manner, the container is formed.

The height of the supporting wall of the second article supporting section for supporting the finger grip of the syringe is smaller than that of the three-dimensional rectangular frame, namely, the height of the four side walls, and is smaller than that of the longer side of the flat portion of the finger grip. Therefore, when the finger grip is inserted into the supporting window of the second article supporting section, with the longer side of the flat portion disposed vertically, the upper portion of the finger grip projects upward from the second article supporting section.

Because the first and second lower flaps are connected with each other, the lower flaps are prevented from moving independently and thus, the supporting sections fixed to the lower flaps can be prevented from being removed therefrom. Hence, the syringe can be easily removed from the container.

In the container according to the second invention, there is provided the first bottom wall, which continues with the lower edge of the first side wall disposed on one side of the row and has the engaging portion defined at the lower edge thereof and the connecting portion defined at a side thereof via the inclined fold line, thus closes one half of the lower opening of the rectangular frame. There is also provided the first lower flap, which continues with the lower edge of the second side wall adjacent to the first side wall, and is connected with the folded connecting portion of the first bottom wall with adhesive agent. Further, there is provided the second bottom wall, similar to the first bottom wall in configuration and continuous with the lower edge of the third side wall adjacent to the second side wall is connected with the engaging portion of the first bottom wall in engagement therewith. The second lower flap is continuous with the lower edge of the fourth side wall adjacent to the third side wall and is connected with the connecting portion of the second bottom wall. The first lower flap has the aperture, formed thereon, into which the corner of the second bottom wall is inserted. The second lower flap has the slit, formed thereon, into which the edge of the first bottom wall is inserted. Accordingly, the long first article supporting section can be formed by bonding the bonding portion thereof to the edge of the first lower flap. In addition, even though the first article supporting section is long, the sheet can be folded into the three-dimensional container with one touch. That is, the container can be easily manufactured and used very conveniently.

The container according to the second invention is formed as follows. First, the first and second upper flaps are folded along each fold line. Then, the first and second lower flaps corresponding to each of the first and second upper flaps are folded back along each fold line and overlaid on the supporting wall of the first article supporting section and the supporting wall of the second article supporting section, respectively. Then, the bonding portion continuous with each supporting wall is bonded to each lower flap with adhesive agent. Then, the first and second bottom walls are folded back along each fold line and overlaid on each of the first and third side walls. Thereafter, the connecting portions are folded back along each inclined fold line and overlaid on the first and second bottom walls, respectively.

Then, the row is folded along the fold line disposed between the first and second side walls and the fold line disposed between the third and fourth side walls. Each connecting portion is overlaid on each lower flap and fixed thereto. Then, the connecting portion of the first side wall is bonded to one end of the fourth side wall with adhesive agent.

Then, the sheet is folded double along the fold line disposed between the second and third side walls to overlay the one half on the other half. In this manner, the sheet is in a temporary assembled state. The container is stored and transported in this state until an article such as the syringe is accommodated therein. In order to make the container three-dimensional, first, the four side walls are made to be perpendicular to each other. The connecting portions of each of the first and second bottom walls have already been bonded to the first and second lower flaps, respectively. Therefore, the first and second bottom walls are pressed downward, and the engaging portion of the first bottom wall engages the engaging portion of the second bottom wall.

In this operation, the first lower flap and the second lower flap opposed to the first lower flap are pressed downward simultaneously, and the corner of the second bottom wall is inserted into the aperture of the first lower flap, and further, one side edge of the first bottom wall opposed to the second bottom wall is inserted into the slit formed on the second lower flap. In this manner, the first bottom wall, the second bottom wall, the first lower flap, and the second lower flap are connected with each other, thus forming the closed bottom of the container.

As a result, the supporting walls connected with each of the first and second lower flaps become perpendicular to each of the first and second lower flaps. Consequently, the supporting walls and the upper supporting portion continuous with each of the supporting walls form a pair of the first and second article supporting sections such that the first and second article supporting sections are opposed to each other inside the three-dimensional rectangular container.

In the thus assembled container, the body of the syringe and the predetermined rear end thereof are inserted into the supporting windows formed on the upper supporting portions and the supporting walls of each of the first and second article supporting sections, with the longer side of the flat portion of the finger grip disposed vertically and with the space provided between the supporting walls.

As described above, according to the container of the present invention, each of the first and second article supporting sections has the supporting portion which includes the supporting window formed on the supporting portion, and the supporting wall. Thus, articles such as the syringe inserted into the supporting windows can be reliably held by both the first and second article supporting sections between which a space is provided. In folding the supporting portions of the first and second article supporting sections, a space is provided between the first and second article supporting sections. The space absorbs vibrations applied to the container from outside, thus protecting the article supported by the container and holding the article against unexpected movement of the article in the lengthwise direction thereof. Hence, the article can be prevented from colliding with the side walls.

The holding projections formed on the supporting windows prevent the syringe from being shaken or removed from the supporting windows. Hence, the syringe or the like can be removed from the container by only pulling it upward against the resistance of the holding projections.

As described above, after the syringe is accommodated in the container, the top wall is folded along the upper edge of the first side wall to cover the rectangular container.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
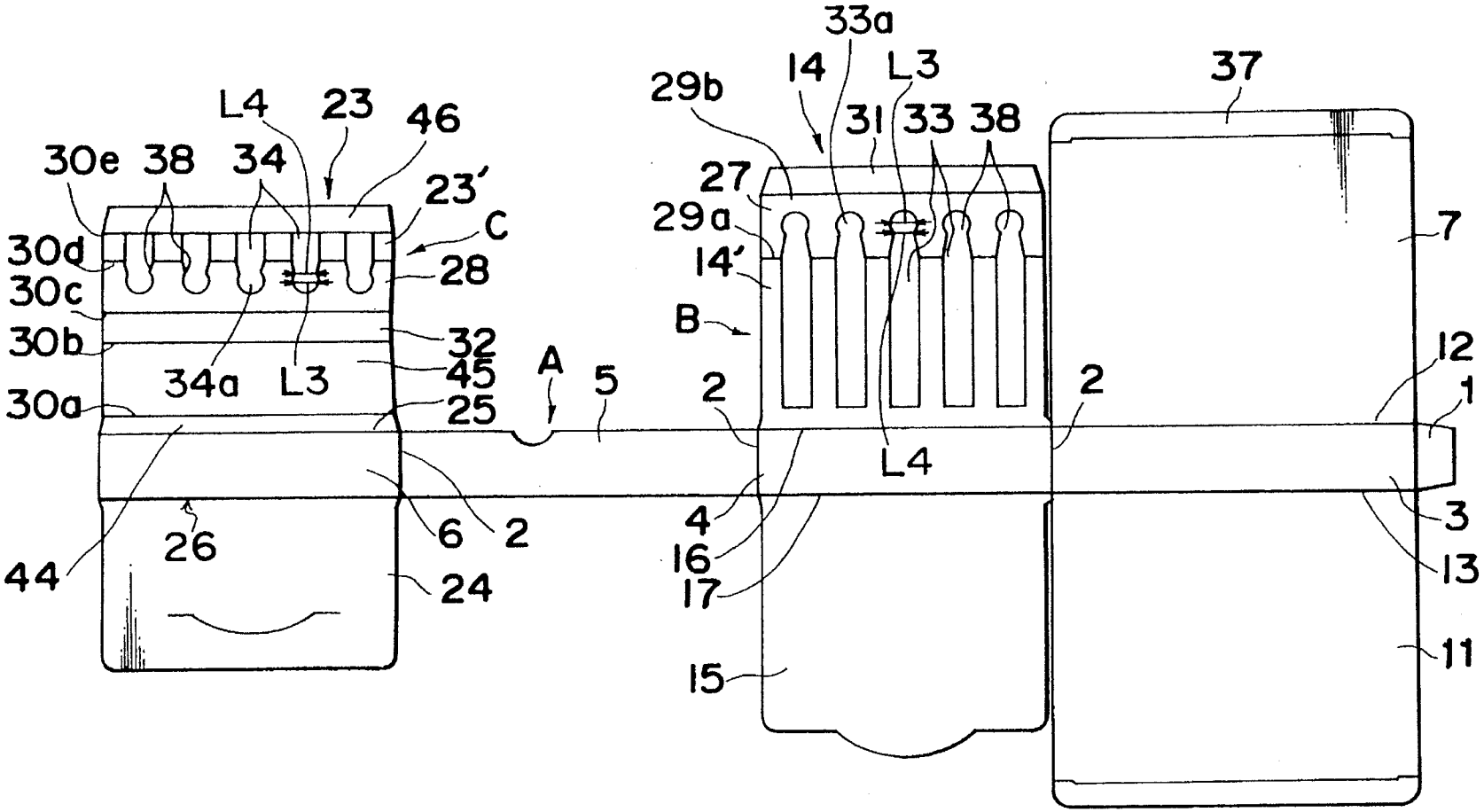
FIG. 1 is a top plan view showing a sheet which can be folded into a container according to a first embodiment of the present invention.

Before the description of the present invention proceeds, it is to be noted that like parts are designated by like reference numerals throughout the accompanying drawings.

Figure 4:
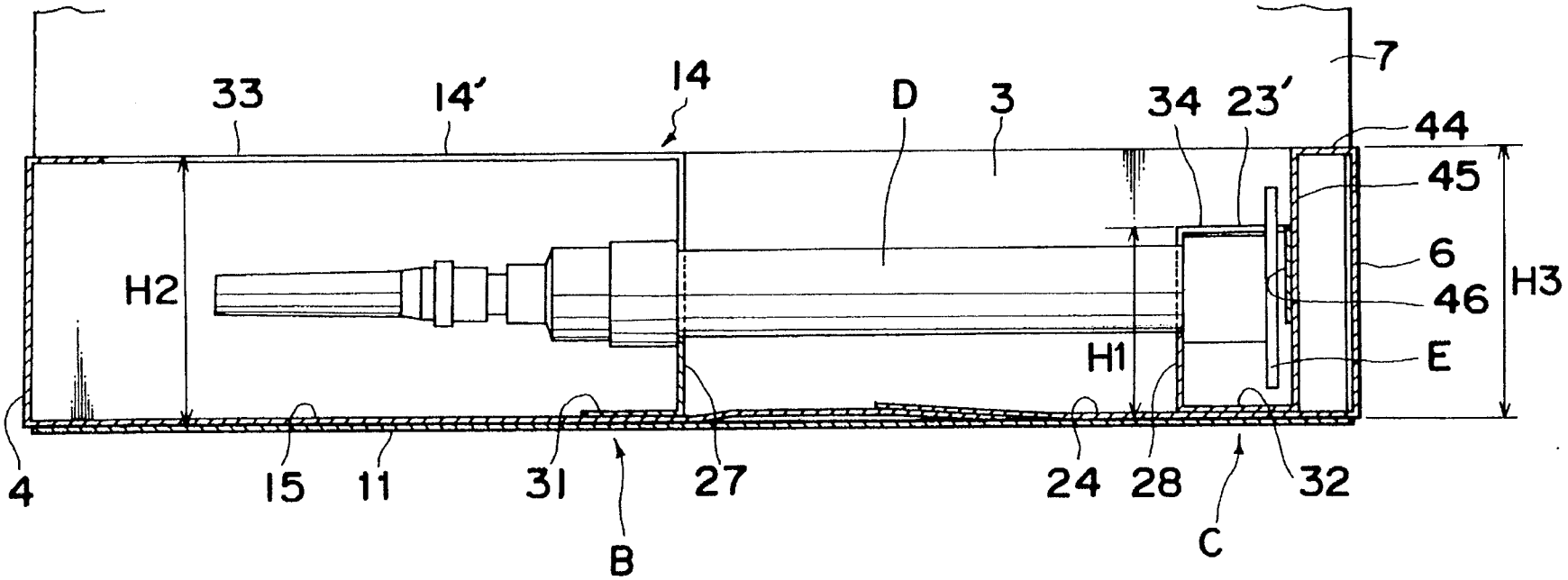
FIG. 4 is a vertical side view showing a state in which a syringe is supported in the container according to the first embodiment.

A container according to a first embodiment of the present invention is described below with reference to FIGS. 1 and 4. As shown in FIG. 1 which is a development view, the container is composed of a thick sheet.

Referring to FIG. 1, the container comprises a row (A) consisting of four side walls 3, 4, 5, and 6 continuous with each other via three fold lines 2 spaced at predetermined intervals. A connecting portion 1 projecting from one end of the side wall 3 is bonded to one end of the side wall 6.

A top wall 7 is formed continuously with the upper edge of the side wall 3 disposed on one side of the row (A) via a fold line 12, thus closing the upper opening of a rectangular frame to be formed. A first bottom wall 11 is formed continuously with the lower edge of the side wall 3 via a fold line 13, thus closing the lower opening of the rectangular frame.

A first upper flap 14 is formed continuously with the upper edge of the side wall 4 adjacent to the side wall 3 via a fold line 16 and folded to form a first article supporting section (B). A first lower flap 15 is formed continuously with the lower edge of the side wall 4 via a fold line 17. A bonding portion 31 of the folded first article supporting section (B) is bonded to the first lower flap 15.

A second upper flap 23 is formed continuously, via a fold line 25, with the upper edge of the side wall 6 disposed on the other side of the row (A) and folded to form a stepped second article supporting section (C). The second article supporting section (C) for supporting a finger grip (E) of a syringe (D) is lower than the first article supporting section (B) and confronts the first article supporting section (B) when the container has been formed. A second lower flap 24 is formed continuously with the lower edge of the side wall 6 via a fold line 26. A bonding portion 32 of the second upper flap 23 constituting the folded second article supporting section (C) is bonded to the second lower flap 24. The second lower flap 24 is connected with the first lower flap 15.

In the first and second upper flaps 14 and 23, supporting walls 27 and 28 of each of the first and second article supporting sections (B) and (C) are formed continuously with each of the bonding portions 31 and 32 to be bonded to the first and second lower flaps 15 and 24, respectively. In the first upper flap 14, a plurality of supporting windows 33 is formed at regular intervals on an upper supporting portion 14' and the supporting wall 27. In the second upper flap 23, a plurality of supporting windows 34 is formed at regular intervals on an upper supporting portion 23' and the supporting wall 28.

Describing the construction of the first upper flap 14 more specifically, two fold lines **29*a* and 29*b* are formed at a predetermined interval in parallel with the fold line 16 to define the upper supporting portion 14' between the fold lines 16 and 29*a*, the supporting wall 27 between the fold lines 29*a* and 29*b*, and the bonding portion 31 between the fold line 29*b* and the upper edge of the first upper flap 14. The upper supporting portion 14' is folded inward along the fold line 16 such that the upper supporting portion 14' makes a substantially right angle with the side wall 4. The supporting wall 27 is folded downward along the fold line 29*a* such that supporting wall 27 makes a substantially right angle with the upper supporting portion 14'. The bonding portion 31 is folded toward the side wall 4 along the fold line 29*b* such that the bonding portion 31 makes a substantially right angle with the supporting wall 27 so that the bonding portion 31 is bonded to the first lower flap 15** with adhesive agent.

Describing the construction of the second upper flap 23 more specifically, five fold lines **30*a*, 30*b*, 30*c*, 30*d*, and 30*e* parallel with the fold line 25 are formed thereon at required intervals. The region between the fold line 25 and the fold line 30*a* is folded inwardly horizontally to define an upper wall 44. The region between the fold line 30*a* and the fold line 30*b* is folded downward in parallel with the side wall 6, i.e., the region makes a substantially right angle with the upper wall 44 to define an inner vertical wall 45. The region between the fold line 30*b* and the fold line 30*c* is folded inwardly horizontally to define the bonding portion 32 to be bonded to the second lower flap 24 with adhesive agent. The region between the fold line 30*c* and the fold line 30*d* is folded upward in parallel with the side wall 6, i.e., the region makes a substantially right angle with the bonding portion 32 to define the supporting wall 28. The region between the fold line 30*d* and the fold line 30*e* is folded outward horizontally, i.e., the region makes a substantially right angle with the supporting wall 28 to define the upper supporting portion 23'. The region between the fold line 30*e* and the upper edge of the second upper flap 23 is folded downward in parallel with the side wall 6, i.e., the region makes a substantially right angle with the upper supporting portion 23' to define a bonding portion 46 to be bonded to the inner vertical wall 45. The height H1 (see FIG. 4) of the upper supporting portion 23', namely, the length of the supporting wall 28 is lower than the height H2 of the upper supporting portion 14' of the first article supporting section (B), namely, the length of the supporting wall 27**.

Figure 12:
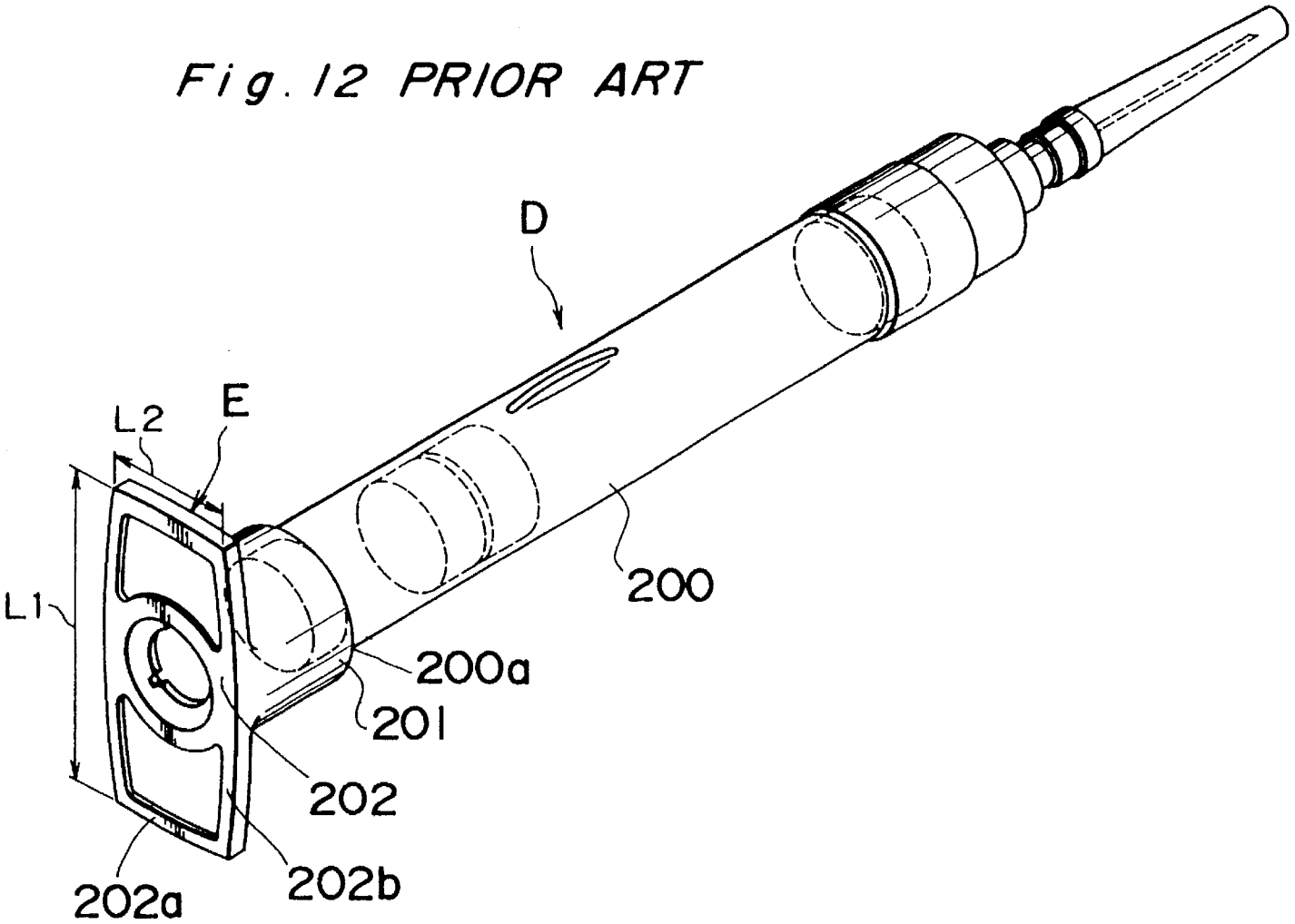
Fig. 12 PRIOR ART
FIG. 12 is a perspective view showing a syringe having a finger grip provided thereon.

When the second upper flap 23 is folded in six to form the container, the upper supporting portion 23' is disposed in a required length toward the center of the container, thus locking a stepped portion 200*a* (see FIG. 12) of the syringe (D) disposed at the rear end of the body 200 thereof.

The vertical length of the supporting wall 28 of the second article supporting section (C), composed of the second upper flap 23, supports the finger grip (E) provided the syringe (D) is shorter than the height H3 (H3=H2) of the rectangular frame, namely, the vertical length of the side walls 3, 4, 5, and 6, and is shorter than the vertical length L1 of the longer side of a flat portion 202 (see FIG. 12) of the finger grip (E). The height H1 of the supporting window 34 of the supporting wall 28, namely, the length H1 between the fold line 30*d* and the lowermost end of the supporting wall 28 of the supporting window 34, is approximately half the vertical length L1 (see FIG. 12) of the longer side of the flat portion 202 of the finger grip (E). That is, the second article supporting section (C) is stepped. The width of the supporting window 34 is set to be greater than the length L2 (see FIG. 12) of the shorter side of the flat portion 202 of the finger grip (E) and shorter than the above-described length L1.

An insertion portion 37 formed on the upper edge of the top wall 7 is inserted into the gap between the side wall 5 and one edge of the upper supporting portion 14' as well as one edge of the upper supporting portion 23'. The holding projection 38 formed on each of the supporting windows 33 and 34 disposed on the supporting walls 27 and 28 tightly holds the forward portion of the body 200 of the syringe (D) and the rear end of the body 200. A width L4 between one side of projection 38 and other side thereof is shorter than a width L3 of an end portion 33*a*, 34*a* of window 33 and 34, into which the finger grip (E) is inserted.

In addition to the bottom wall 11 according to the first embodiment, the bottom wall 11 for closing the lower opening of the container may be connected with the lower flaps 15 and 24 like a conventional one.

Figure 2:
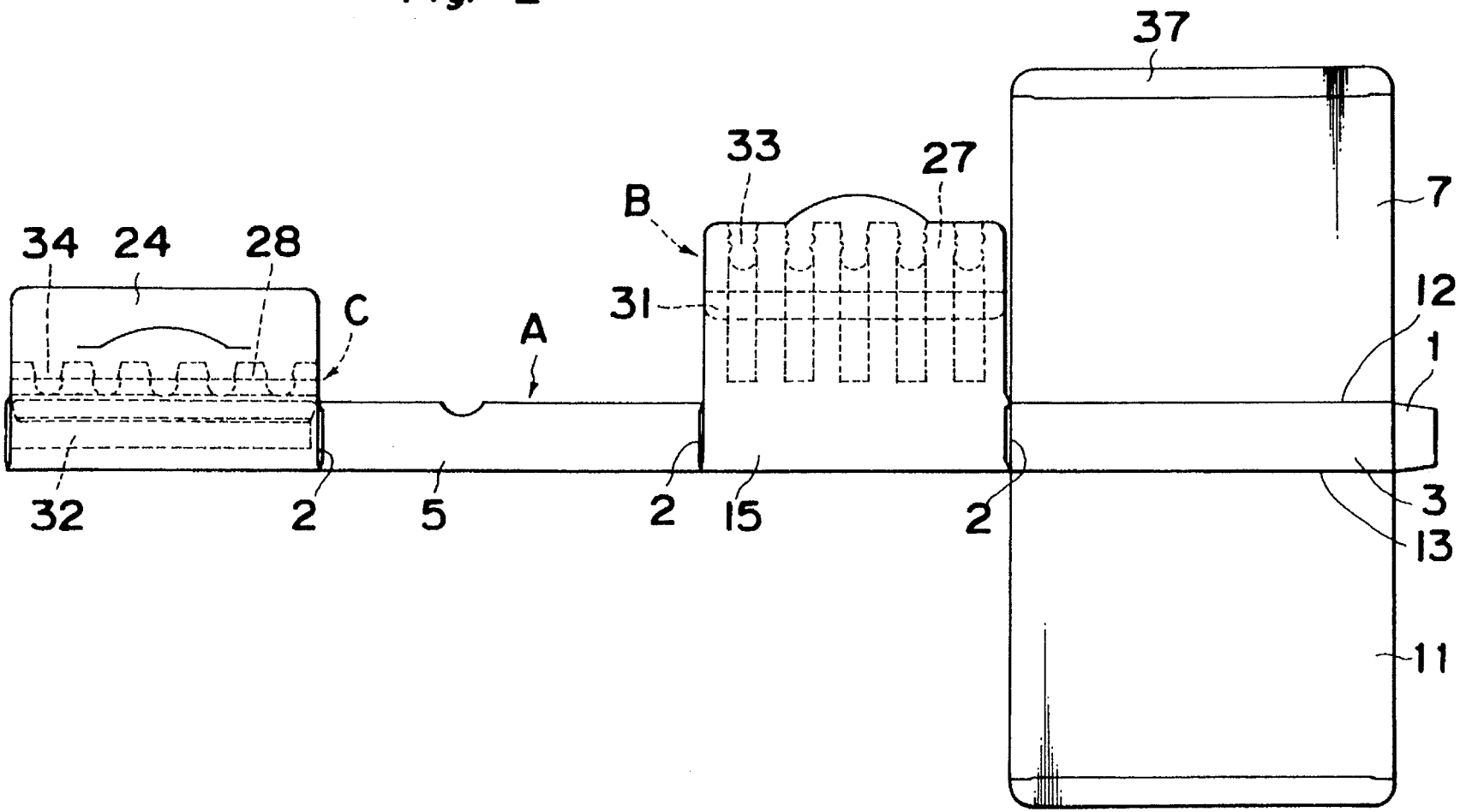
FIG. 2 is a top plan view showing the container according to the first embodiment being assembled.

The container according to the first embodiment is formed as follows and also as shown in FIG. 2. First, the first upper flap 14 is folded along the fold lines 29*a* and 29*b* to form the first article supporting section (B).

Then, the second upper flap 23 is folded along each of the fold lines 30*a* through 30*e* to form the second article supporting section (C), and the bonding portion 46 of the second upper flap 23 is bonded to the inner vertical wall 45 of the second upper flap 23 with adhesive agent.

The first and second lower flaps 15 and 24 corresponding to each of the first and second upper flaps 14 and 23 are folded along each of the fold lines 17 and 26 and overlaid on the supporting wall 27 of the first article supporting section (B) and the supporting wall 28 of the second article supporting section (C), respectively. In the first upper flap 14 to form the first article supporting section (B), the bonding portion 31 continuous with the supporting wall 27 is bonded to the first lower flap 15 with adhesive agent.

In the second upper flap 23 to form the second article supporting section (C), the bonding portion 32 continuous with the supporting wall 28 is bonded to the second lower flap 24 with adhesive agent. Subsequently, the bonding portion 46 is bonded to the inner vertical wall 45 with adhesive agent.

Then, the row (A) is folded along the fold line 2 disposed between the side walls 3 and 4 and the fold line 2 disposed between the side walls 5 and 6, and the connecting portion 1 of the side wall 3 is bonded to one end of the side wall 6 with adhesive agent. Then, the sheet is folded double along the fold line 2 disposed between the side walls 4 and 5 to overlay the one half on the other half. In this manner, all to-be-bonded portions have been bonded with adhesive agent and all to-be-folded portions have been folded. That is, the sheet is in a temporary assembled state. In order to allow the flatly folded sheet to be three-dimensional, the side walls 3, 4, 5, and 6 are located to make right angles with each other.

In storing and transporting the sheet, it is flatly folded, whereas the sheet is assembled in the predetermined three-dimensional configuration to accommodate an article such as a syringe.

Figure 3:
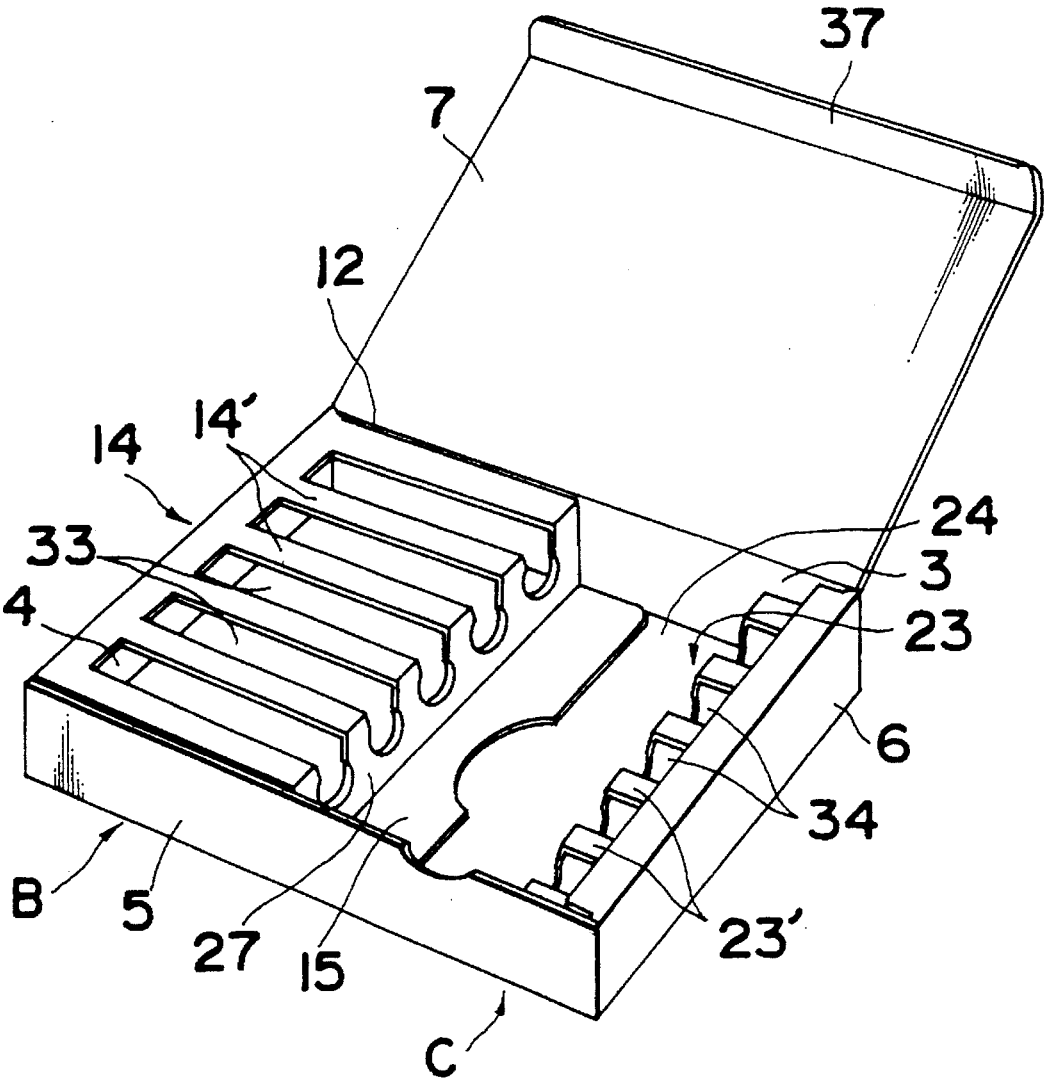
FIG. 3 is a perspective view showing a state in which the container according to the first embodiment has been assembled.

In order to make the sheet into the three-dimensional container as shown in FIG. 3, first, the side walls 3, 4, 5, and 6 are located to be perpendicular to each other. Then, the first and second lower flaps 15 and 24 overlaid on each of the first and second article supporting sections (B) and (C) are located in such a position that the first and second lower flaps 15 and 24 form a right angle with each of the side walls 4 and 6. As a result, the supporting walls 27 and 28 connected with each of the first and second lower flaps 15 and 24 via each of the bonding portions 31 and 32 become perpendicular to each of the first and second lower flaps 15 and 24. Consequently, the supporting walls 27 and 28 and the upper supporting portions 14' and 23' continuous with each of the supporting walls 27 and 28 form a pair of the first and second article supporting sections (B) and (C) such that the first and second article supporting sections (B) and (C) are opposed to each other inside the three-dimensional rectangular container. In this manner, the container is formed as shown in FIG. 3.

The height of the supporting wall 28 of the second article supporting section (C) for supporting the finger grip (E) of the syringe (D) is smaller than that of the three-dimensional rectangular frame, namely, the height of the side walls 3, 4, 5, and 6 and smaller than that of the longer side of the flat portion 202 of the finger grip (E). Therefore, when the finger grip (E) is inserted into the supporting window 34 of the second article supporting section (C), with the longer side of the flat portion 202 of the finger grip (E) disposed vertically, the upper portion of the finger grip (E) projects upward from the second article supporting section (C). In addition, the width of the supporting window 34 is set to be smaller than the size of the longer side of the flat portion 202. Accordingly, the supporting window 34 prevents the flat portion 202 from being rotated. Consequently, the upper portion of the finger grip (E) can be reliably projected upward from the second article supporting section (C). That is, the flat portion 202 is prevented from being rotated and thus, the finger grip (E) is never disposed below the upper supporting portion 23'. Hence, it does not an operator will not have difficulty in removing the syringe (D) from the container.

Further, the supporting walls 27 and 28 are spaced appropriately from each of the side walls 4 and 6, and the syringe (D) is supported by the first and second article supporting sections (B) and (C) by utilizing the convex and concave configuration of the syringe (D) in such a manner that the forward and rearward ends of the syringe (D) do not contact each of the side walls 4 and 6. Thus, the syringe (D) can be prevented from being moved in the lengthwise direction thereof. Furthermore, the lower ends of the supporting windows 33 and 34 of the first and second article supporting sections (B) and (C) are located above the first lower flap 15 and the second lower flap 24, respectively. Thus, the syringe (D) and the finger grip (E) thereof supported by each of the supporting windows 33 and 34 can be prevented from contacting the bottom surface of the container. Further, the height of the side walls is set to prevent the syringe (D) and the finger grip (E) from contacting the top wall 7. In addition to the supporting windows 33 and 34, the projections 38 formed thereon hold the syringe (D) tightly. Accordingly, the syringe (D) can be stably held by the supporting windows 33 and 34 and the projections 38 against vibrations which occur in all directions, namely, in the vertical, lengthwise, and widthwise directions of the syringe (D).

A container according to a second embodiment of the present invention is described below with reference to FIGS. 5 through 8. A row (A') consisting of side walls 3', 4', 5', and 6', a top wall 7', first and second upper flaps 114 and 123 according to the second embodiment of the present invention have the same configurations as those according to the first embodiment, whereas bottom walls and lower flaps according to the second embodiment are different from those according to the first embodiment.

Figure 5:
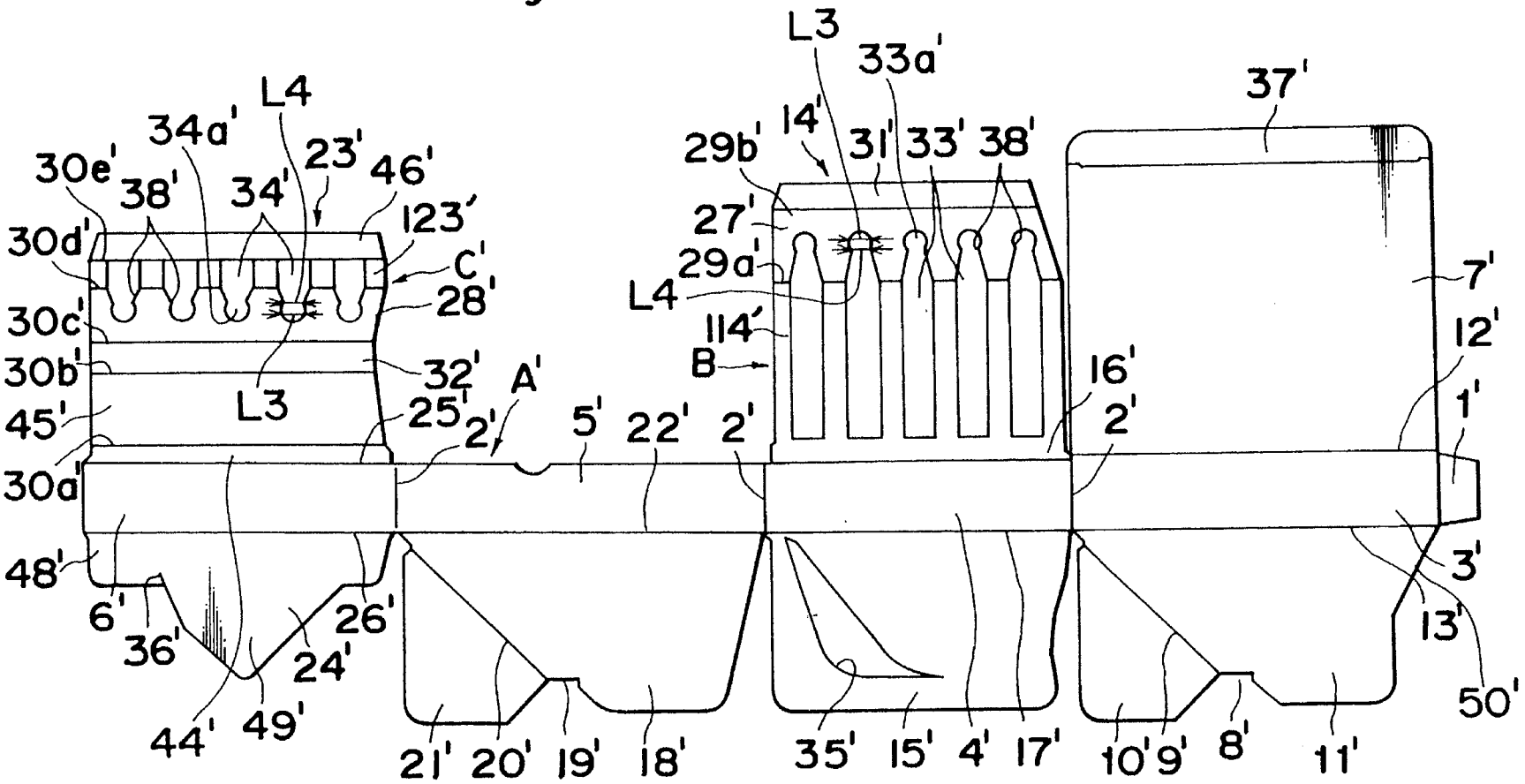
FIG. 5 is a top plan view showing a sheet which can be folded into a container according to a second embodiment of the present invention.

Referring to FIG. 5, the container to be formed comprises the row (A') consisting of the four side walls 3', 4', 5', and 6' continuous with each other via three fold lines 2' spaced at predetermined intervals. A connecting portion 1' projecting from one end of the side wall 3' is bonded to one end of the side wall 6'.

That is, the top wall 7' is formed continuously with the upper edge of the side wall 3' disposed on one side of the row (A') via a fold line 12', thus opening and closing the upper opening of the container. A first bottom wall 11' is formed continuously with the lower edge of the side wall 3' via a fold line 13'. The first bottom wall 11' has an engaging portion 8' defined at the center of the lower edge thereof and a connecting portion 10' defined at a side opposed to a first lower flap 15' via an inclined fold line 9' making a 45° angle with the side wall 3', thus closing the lower opening of the three-dimensional rectangular frame by half.

A first upper flap 114 is formed continuously with the upper edge of the side wall 4' adjacent to the side wall 3' via a fold line 16'. The first upper flap 114 is folded to form a first article supporting section (B'). The first lower flap 15 is formed continuously with the lower edge of the side wall 4 via a fold line 17. A bonding portion 31 of the folded first article supporting section (B) is bonded to the first lower flap 15. One side of the first lower flap 15 is connected with the connecting portion 10 of the first bottom wall 11 with adhesive agent. An aperture 35 is formed on the side, of the first lower flap 15, opposite to the side to be bonded to the connecting portion 10 of the first bottom wall 11. The aperture 35 is formed in a configuration, for example, an arched configuration into which a corner of a second bottom wall 18' adjacent to the first lower flap 15' is inserted when the bottom of the rectangular frame is formed.

It is impossible to dispose the second bottom wall 18 over the first lower flap 15' because the bonding portion 31 of the first upper flap 114 of the first article supporting section (B') is bonded to the first lower flap 15' with adhesive agent. Thus, the aperture 35' is provided to allow the corner of the second bottom wall 18' to confront the bottom surface of the first upper flap 114 in combining the first lower flap 15' and the second bottom wall 18' with each other to form the bottom of the three-dimensional rectangular container.

The second bottom wall 18' similar to the first bottom wall 11' in its configuration is formed continuously with the lower edge of the side wall 5' via a fold line 22'. The second bottom wall 18' has an engaging portion 19' defined at the center of the lower edge thereof and a connecting portion 21' defined at a side opposed to a second lower flap 24' via an inclined fold line 20' making a 45° angle with the side wall 5', thus closing the lower opening of the rectangular frame by half.

The second upper flap 123 is formed continuously, via a fold line 25', with the upper edge of the side wall 6' disposed on the other side of the row (A'). The second upper flap 123 is folded to form a second article supporting section (C') which confronts the first article supporting section (B') when the sheet is formed into the container. The second lower flap 24' is formed continuously with the lower edge of the side wall 6' via a fold line 26'. The second lower flap 24' has a side portion 48' substantially parallel with the side wall 6' and a mountain-shaped center portion 49' projecting from the center of the side portion 48'. A bonding portion 32' of the second upper flap 123 is bonded to the side portion 48' with adhesive agent. The connecting portion 21' of the second bottom wall 18' adjacent to the second lower flap 24' is also bonded to one side of the mountain shaped center portion 49' with adhesive agent.

A slit 36' is formed at one side, of the center portion 49' of the second lower flap 24', opposite to the side bonded to the connecting portion 21'. A side edge 50' of the first bottom wall 11' adjacent to the second lower flap 24' is inserted into the slit 36' in forming the bottom of the rectangular frame.

Similarly to the first embodiment, in the first upper flap 114, a plurality of supporting windows 33' is formed at regular intervals on an upper supporting portion 114' and a supporting wall 27', and in the second upper flap 123, a plurality of supporting windows 34' is formed at regular intervals on an upper supporting portion 123' and a supporting wall 28'. The intervals on the upper supporting portion 123' are the same as the intervals on the upper supporting portion 114'.

The construction and height of the first and second article supporting sections (B') and (C') and the construction of the supporting windows 33' and 34' according to the second embodiment are all the same as those according to the first embodiment. Therefore, they are not described herein.

An insertion portion 37' formed on the upper edge of the top wall 7' is inserted into the gap between the side wall 5' and one edge of the upper supporting portion 114' as well as one edge of the upper supporting portion 123'. The holding projections 38' formed on the supporting windows 33 and 34' disposed on each of the supporting walls 27' and 28' tightly hold a syringe (D).

Figure 6:
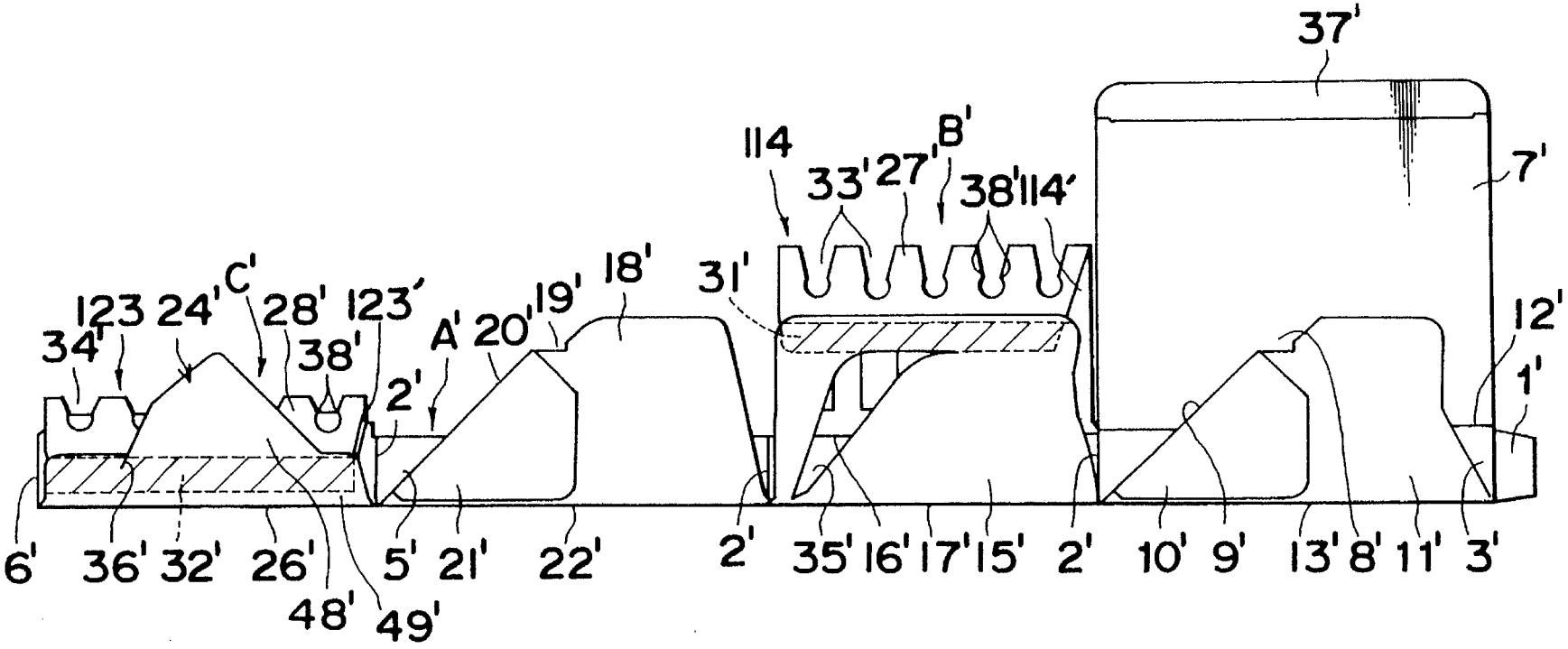
FIG. 6 is a top plan view showing the container according to the second embodiment being assembled.

The container according to the second embodiment is formed as follows and also as shown in FIG. 6. First, the first upper flap 114 to form the first article supporting section (B') is folded along the fold lines **29*a*' and 29*b*'. Then, the second upper flap 123 to form the second article supporting section (C') is folded along each of the fold lines 30*a*' through 30*e*'. At this time, the bonding portion 46' disposed at the upper end of the second upper flap 123 is bonded to the inner vertical wall 45' in a region with adhesive agent such that the upper supporting portion 123' is substantially perpendicular to the inner vertical wall 45'**.

The first and second lower flaps 15' and 24' corresponding to each of the first and second upper flaps 114 and 123 are folded along each of the fold lines 17' and 26' and overlaid on the supporting wall 27' of the first article supporting section (B') and the supporting wall 28' of the second article supporting section (C'), respectively. Then, the bonding portion 31' disposed at the upper end of the first upper flap 114 is bonded to the first lower flap 15' with adhesive agent in such a manner that the bonding portion 31' does not interfere with the aperture 35', and the bonding portion 32' of the second upper flap 123 is bonded to the side portion 48' of the second lower flap 24' with adhesive agent.

Then, the first and second bottom walls 11' and 18' are folded back along each of the fold lines 13' and 22' and overlaid on the side walls 3' and 5', respectively. Thereafter, the connecting portions 10' and 21' are folded back along each of the inclined fold lines 9' and 20' and overlaid on the first and second bottom walls 11' and 18', respectively.

Figure 7:
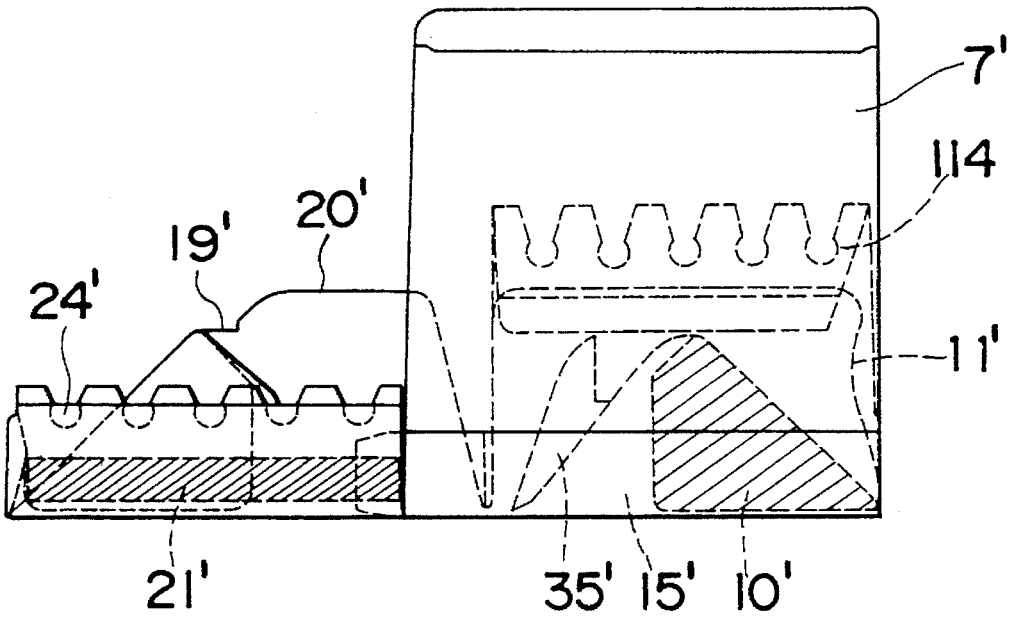
FIG. 7 is a top plan view showing a state of assembly subsequent to that process shown in FIG. 6 according to the second embodiment.

Then, as shown in FIG. 7, the row (A') is folded along the fold line 2' disposed between the side walls 3' and 4' and the fold line 2' disposed between the side walls 5' and 6'. As a result, the connecting portion 10' overlaid on the first bottom wall 11' is overlaid on the first lower flap 15' adjacent to the bottom wall 11'. Then, the connecting portion 10' is bonded to the first lower flap 15' with adhesive agent. Similarly, the connecting portion 21' overlaid on the second bottom wall 18' is overlaid on the side of the center portion 49' of the second lower flap 24'. Then, the connecting portion 21' is bonded to the second lower flap 24' with adhesive agent.

Oblique lines shown in FIG. 7 shows the bonding portion between the connecting portion 10' and the first lower flap 15', between the connecting portion 21' and the second lower flap 24', between the bonding portion 31' and the first lower flap 15', and between the bonding portion 32' and the second lower flap 24'.

Then, the connecting portion 1' of the side wall 3' is bonded to one end of the side wall 6' with adhesive agent.

Then, the sheet is folded double along the fold line 2' disposed between the side walls 4' and 5' to overlay the one half on the other half. In this manner, all to-be-bonded portions have been bonded with adhesive agent and all to-be-folded portions have been folded. That is, the sheet is in a temporary assembled state. In order to allow this state to be in a three-dimensional state, the side walls 3', 4', 5', and 6' are located at right angle with each other.

The container is stored and transported in the state as shown in FIG. 7 until an article such as the syringe (D) is accommodated therein.

Figure 8:
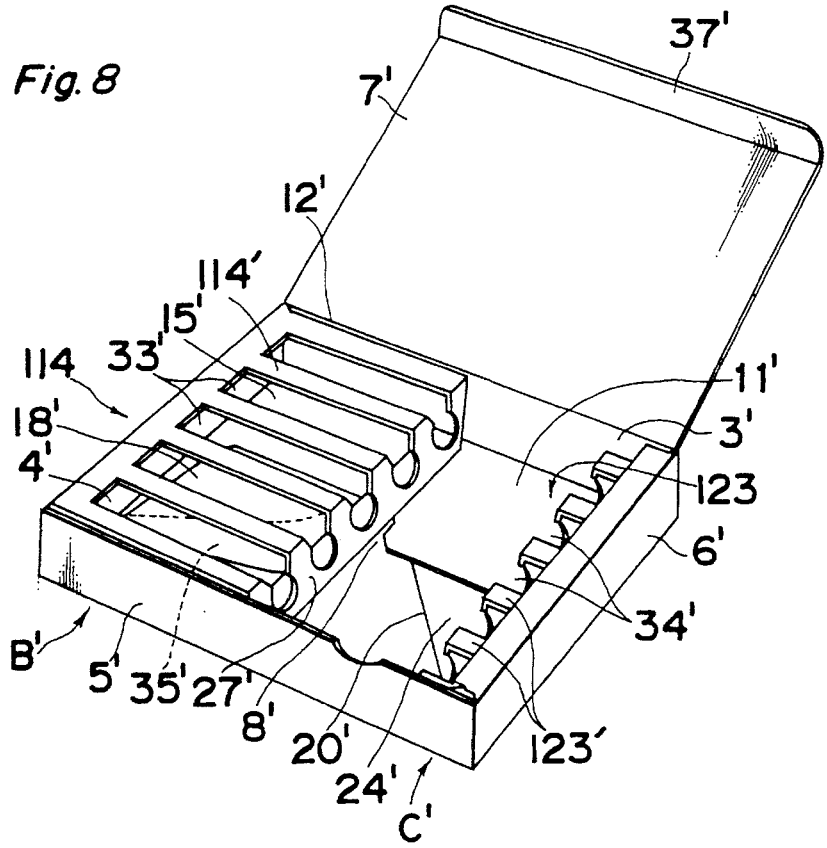
FIG. 8 is a perspective view showing a state in which the container according to the second embodiment has been assembled.

In order to place the container as shown in FIG. 7 in a three-dimensional as shown in FIG. 8, first, both ends of the container are folded double, namely, the fold line 2' disposed between the side walls 3' and 4' and the fold line 2' between the side walls 5' and 6' are pressed inward. Otherwise, the fold line 2' disposed between the side walls 3 and 6 and the fold line 2' between the side walls 4' and 5' are pulled in opposite directions. Consequently, the side walls 3', 4', 5', and 6' become perpendicular to each other. The connecting portions 10 and 21' of each of the first and second bottom walls 11 and 18' have been already bonded to the first and second lower flaps 15 and 24', respectively. Therefore, the first and second bottom walls 11 and 18' are pressed downward. Consequently, the corner of the second bottom wall 18 is inserted into the aperture 35' of the first lower flap 15, and further, one side edge 50' of the first bottom wall 11 opposed to the second bottom wall 18' is inserted into the slit 36' formed on the second lower flap 24', while the container-assembling process proceeds. In this manner, the first bottom wall 11', the second bottom wall 18, the first lower flap 15', and the second lower flap 24' are connected with each other, thus forming the closed bottom of the container.

At the final stage of forming the closed bottom, the engaging portion 8 of the first bottom wall 11' engages the engaging portion 19 of the second bottom wall 18'.

Simultaneously, the supporting walls 27 and 28' connected with each of the first and second lower flaps 15 and 24 via each of the bonding portions 31' and 32' become perpendicular to each of the first and second lower flaps 15' and 24'. Consequently, the supporting walls 27' and 28' and the upper supporting portion 114' and 123' continuous with each of the supporting walls 27' and 28' form the first and second article supporting sections (B') and (C') such that the first and second article supporting sections (B') and (C') are opposed to each other inside the three-dimensional rectangular container. During the process, the corner of the second bottom wall 18' is inserted into the aperture 35' from a lower side of the first lower flap 15', then the portion of the bottom wall 18' inserted through the aperture 35' is positioned between the first lower flap 15' and the upper supporting portion 114'.

Referring to FIG. 8, in the thus assembled container, the front side of the syringe (D) is inserted into the supporting window 33' formed on the first upper supporting portion 114' to be supported by the supporting wall 27' and the rear side of the syringe is inserted into the supporting window 34' formed on the second upper supporting portion 123' to be supported by the supporting wall 28', with the longer side of the flat portion 202' of the finger grip (E) disposed vertically and with the space provided between the supporting walls 27' and 28'. That is, similarly to the first embodiment, the syringe (D) is accommodated in the container.

It is possible that in the second embodiment, the second article supporting portions (C') and the first article supporting portions (B') are identical with each other in construction and configuration. In this case, an article other than the syringe (D) can be accommodated in the container.

Figure 9:
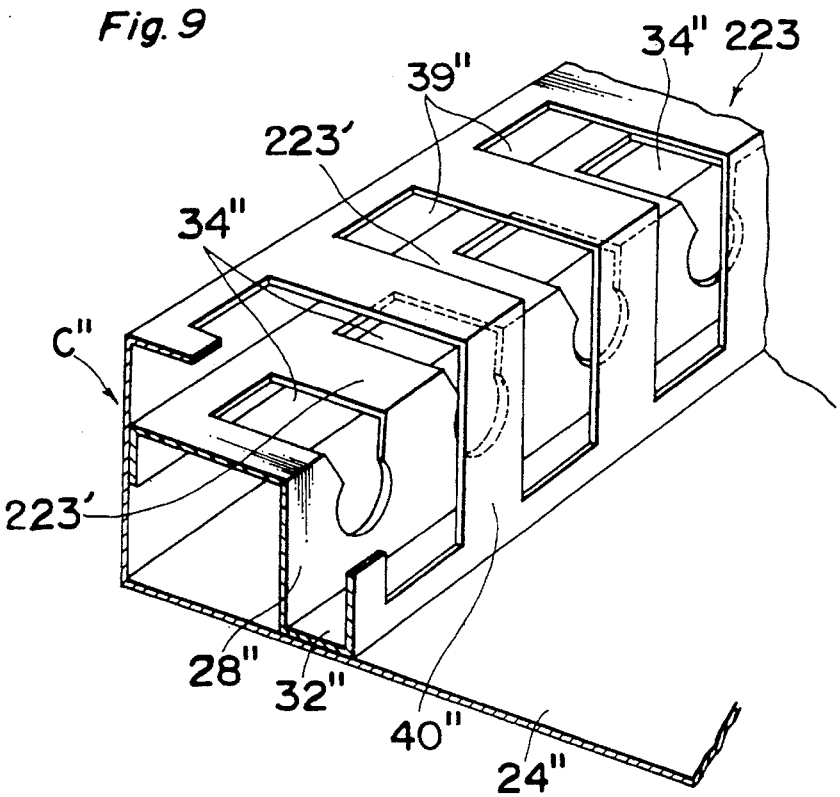
FIG. 9 is a perspective view showing a second supporting section of a container according to a third embodiment of the present invention.
Figure 10:
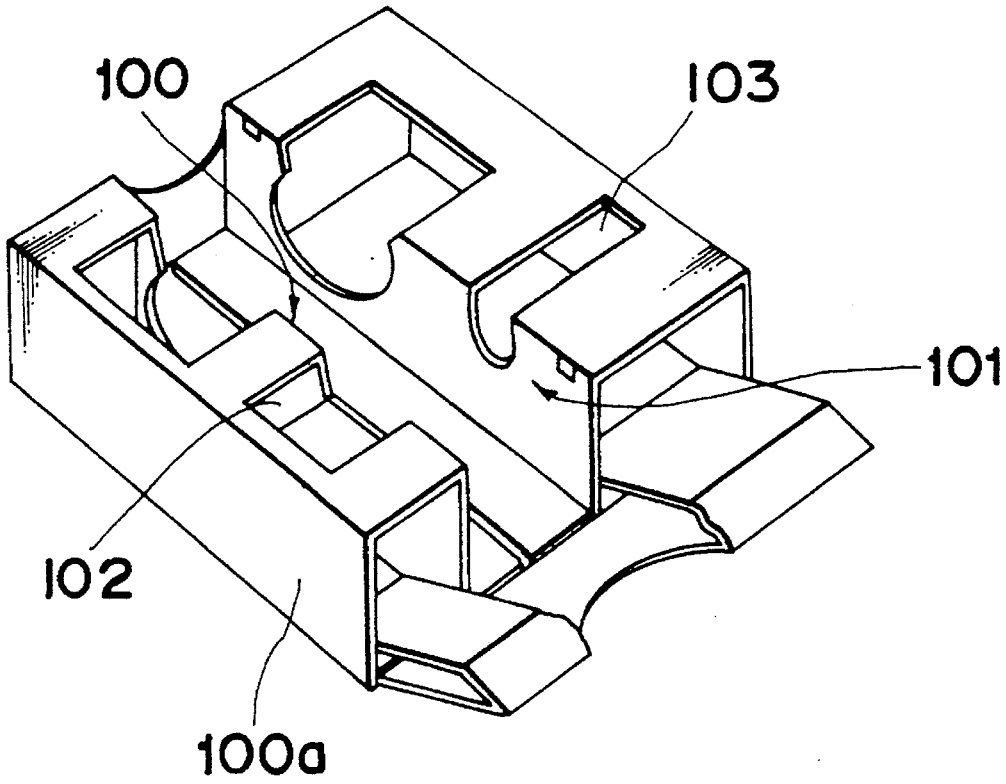
Fig. 10 PRIOR ART
FIG. 10 is a perspective view showing a conventional container.
Figure 11:
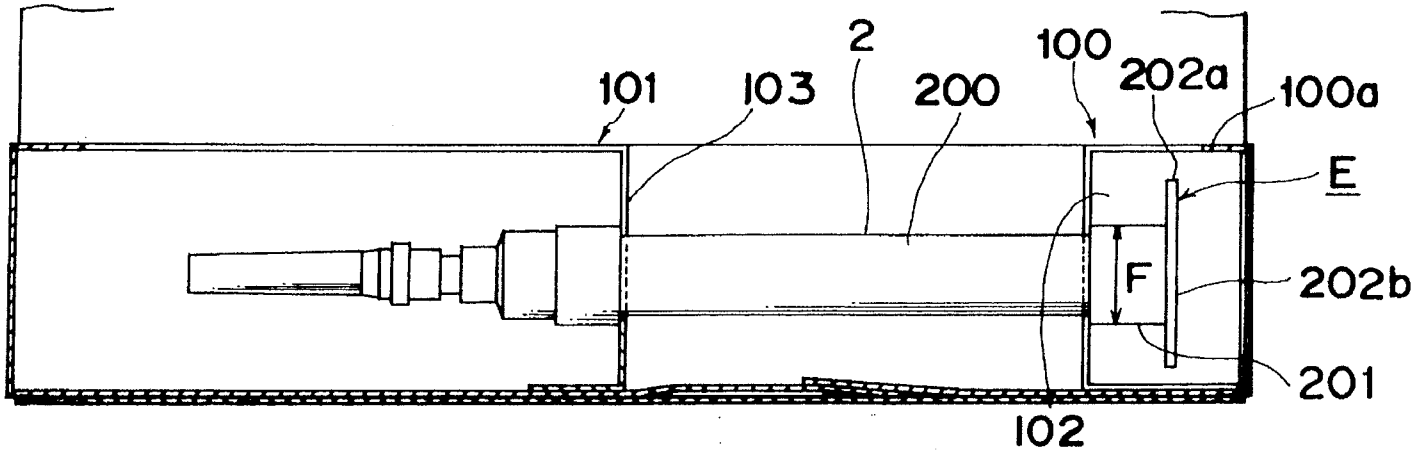
Fig. 11 PRIOR ART
FIG. 11 is a vertical side view showing a state of the conventional container supporting a syringe.
Figure 13:
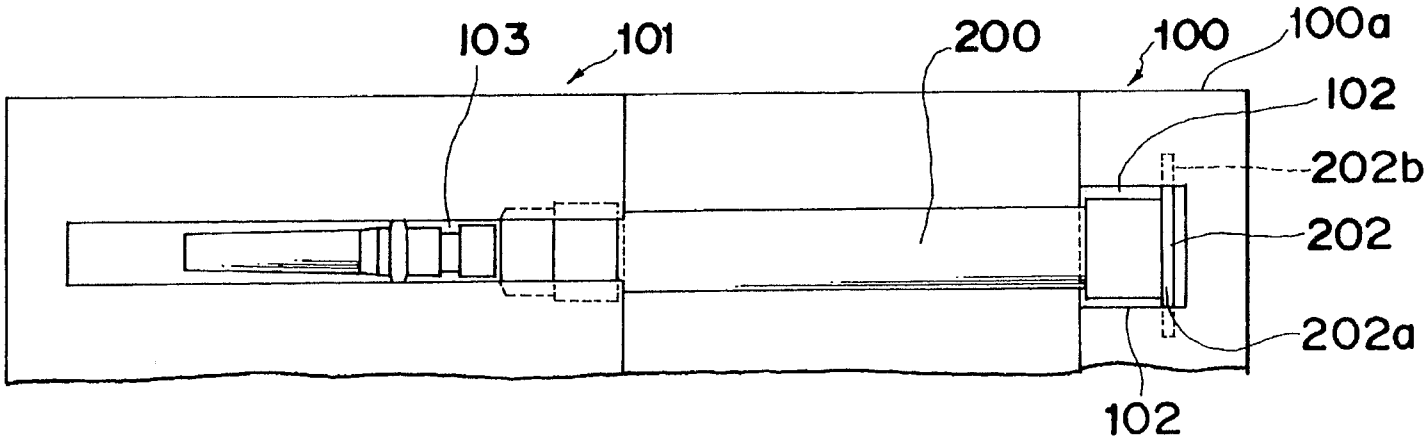
Fig. 13 PRIOR ART
FIG. 13 is a schematic plan view showing a state in which the finger grip has been turned in the conventional container due to the rotation of the syringe.

A container according to a third embodiment of the present invention is described below with reference to FIG. 9. The second article supporting section (C") according to the third embodiment is formed inside an outer wall 39" formed by folding the second upper flap 223 in a configuration of an inverted L. A wide syringe entrance/exit 40" is formed on the outer wall 39".

In the first through third embodiments, the top wall 7 is integral with the side wall 3. But it is possible to prepare a cover sheet separate from the side wall 3.

It is also possible to eliminate the top wall 7 from the container and overlay a plurality of containers one on the other so as to accommodate them in a large case.

As described above, the height of the supporting wall for supporting the finger grip of the syringe is smaller than that of the other supporting wall opposed thereto. Thus, the syringe is supported, with the upper portion of the finger grip projecting upward from the upper supporting portion of the article supporting section. Accordingly, the syringe can be transported with one container overlaid over the other and stored without the syringe being rotated and further maintained in a state for allowing the syringe to be removed from the container easily.

In addition, the bottom wall(s), the upper flaps, and the lower flaps formed on the upper and lower edges of the side walls are folded and predetermined portions are bonded to each other, and both edges of the row consisting of the four side walls are bonded to each other to form a three-dimensional rectangular container. Then, the container can be folded double and one half of the folded container can be overlaid over the other half. Hence, the container can be easily manufactured and stored and transported in a flat configuration. The container can be made to be three-dimensional easily when it is necessary to accommodate syringes or the like. Thus, the container can be manufactured at a low cost.

Both supporting walls are fixed to the lower flaps, and the container can be prevented from becoming flat when both lower flaps are connected with each other. Thus, the syringe can be protected stably and reliably and further, the lower flaps can be prevented from being moved upward from the lower flaps or removed therefrom when the syringe is removed from the container.

The holding projections formed on the supporting windows of the supporting walls prevent the syringe from being shaken or removed from the supporting windows. Hence, the syringe or the like can be stored and transported stably and reliably.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A container, adapted to be assembled by folding a sheet and bonding portions of the sheet to each other, for use in holding an elongated article, said container comprising:

a row of side walls, comprising first, second, third and fourth side walls successively continuous with each other via three fold lines spaced at predetermined intervals, opposing ends of said row being bonded to each other to form a rectangular frame having a lower opening;

a first bottom wall, continuous with a lower edge of the first side wall via a fold line, having an engaging portion defined at a lower edge thereof and a first connecting portion defined at a side thereof via an inclined fold line, and closing approximately one half of the lower opening of the rectangular frame;

a first upper flap, continuous with an upper edge of the second side wall via a fold line and having at least one first supporting window, being folded into the rectangular frame to form a first article supporting section for supporting one side of the article; and a first lower flap, continuous with a lower edge of the second side wall via a fold line and having an aperture defined on one side thereof, the other side of which is connected with the first connecting portion with adhesive agent;

a second bottom wall, continuous with a lower edge of the third side wall via a fold line, having a locking portion defined at a tip edge thereof so that the locking portion is connected with the engaging portion of the bottom wall in engagement therewith and having a second connecting portion defined at one side thereof via an inclined fold line and a corner defined on the other side thereof which is inserted into the aperture to close a remainder of the lower opening of the rectangular frame;

a second upper flap, continuous with an upper edge of the fourth side wall via a fold line and having at least one second supporting window, being folded into the rectangular frame to form a second article supporting section for supporting the other side of the article;

a second lower flap, continuous with a lower edge of the fourth side wall via a fold line and having a slit therein into which an edge of the bottom wall is inserted, wherein a side of the second lower flap is connected with the second connecting portion of the bottom wall with adhesive agent; and wherein, when the sheet is assembled into the rectangular frame, the at least one first supporting window of the first article supporting section and the at least one second supporting window of the second article supporting section are opposed to each other so that the article is supported with one side thereof inserted into the at least one first supporting window and the other side thereof inserted into the at least one second supporting window.

2. A container as recited in claim 1, wherein said first article supporting section includes a first upper supporting portion, and said second article supporting section includes a second upper supporting portion; and said second upper supporting portion is disposed lower than said first upper supporting portion.

3. A container as recited in claim 1, further comprising a top wall, continuous with an upper edge of said second side wall via a fold line, openably closing an upper opening of said rectangular frame.

4. A container as recited in claim 1, wherein the first upper flap forming the first article supporting section comprises a first upper supporting portion extending horizontally on an inner side of the second side wall, a first supporting wall extending vertically and connecting an inner end of the first upper supporting portion and the first lower flap with each other, and a first bonding portion continuous with the first supporting wall and being fixed to the first lower flap with adhesive agent;

the second upper flap forming the second article supporting section comprises a second upper supporting portion extending horizontally on an inner side of the fourth side wall, a second supporting wall extending vertically and connecting an inner end of the second upper supporting portion and the second lower flap with each other, and a second bonding portion continuous with the second supporting wall and being fixed to the second lower flap with adhesive agent;

the at least one first supporting window is defined on the first supporting wall and the first upper supporting portion; and the at least one second supporting window is defined on the second supporting wall and the second supporting portion.

5. A container as recited in claim 1, wherein at least one holding projection is formed on each of said at least one first supporting window and said at least one second supporting window.

6. A container as recited in claim 1, wherein said at least one first supporting window comprises a plurality of parallel first supporting windows spaced apart from one another at regular intervals; and said at least one second supporting window comprises a plurality of parallel second supporting windows spaced apart from one another at regular intervals.

7. A container as recited in claim 1, wherein said first article supporting section has a first predetermined length extending inwardly from said rectangular frame, and said second article supporting section has a second predetermined length extending inwardly from said rectangular frame; and said first predetermined length is greater than said second predetermined length, such that said first article supporting section extends inwardly to approximately a longitudinal center of said frame.

8. A container as recited in claim 1, wherein said second article supporting section comprises an upper supporting portion which is stepped downwardly from an upper edge of said fourth side wall, such that said upper supporting portion is vertically lower than an upper edge of said fourth side wall.

9. A container as recited in claim 8, wherein first, second, third, fourth and fifth fold lines, parallel with the upper edge of said fourth side wall, are formed at predetermined intervals on said second upper flap;

a region between the upper edge of said fourth side wall and said first fold line is folded inwardly to define an upper horizontal wall;

a region between said first fold line and said second fold line is folded downward in parallel with said fourth side wall to define an inner vertical wall;

a region between said second fold line and said third fold line is folded inwardly to define a horizontal bonding portion to be bonded to said second lower flap with adhesive agent;

a region between said third fold line and said fourth fold line is folded upward to define a supporting wall which is parallel with said fourth side wall;

a region between said fourth fold line and said fifth fold line is folded outwardly to define a horizontal upper supporting portion;

a region between said fifth fold line and a distal end of said second upper flap is folded in parallel with said fourth side wall to define a bonding portion to be bonded to said inner vertical wall; and wherein said upper supporting portion of said second article supporting section is disposed vertically lower than an upper supporting portion of said first article supporting section.

10. A container as recited in claim 1, wherein said second upper flap comprises a supporting wall and an upper supporting portion continuous with said supporting wall via a fold line, said at least one second supporting window being formed in said supporting wall and said upper supporting portion; and said second upper flap further comprises an outer wall having an entrance/exit formed therein, said outer wall being disposed outwardly of said supporting wall and said upper supporting portion and being continuous with said supporting wall and said upper supporting portion.

11. A container as recited in claim 1, wherein the article comprises a generally tubular syringe having, at one end thereof, a wing-shaped finger grip which comprises a rectangular flat portion with a shorter side having a length substantially the same as a diameter of the syringe and a longer side having a length greater than the diameter of the syringe; and said finger grip is inserted into said at least one second supporting window of said second article supporting section with the longer side of said finger grip disposed vertically and the upper end thereof projecting from said at least one second supporting window.

12. A container as recited in claim 11, wherein said at least one second window has a width which is greater than the length of said shorter side of said finger grip and is less than the length of said longer side of said finger grip.

13. A container as recited in claim 12, wherein said at least one second supporting window has a height which is approximately half of the length of said longer side of said finger grip.

14. A container, adapted to be assembled by folding a sheet and bonding portions of the sheet to each other, for use in holding an elongated article, said container comprising:

a row of side walls, comprising first, second, third and fourth side walls successively continuous with each other via three fold lines spaced apart at predetermined intervals, opposing ends of said row being bonded to each other to form a rectangular frame having a lower opening;

a bottom wall continuous with a lower edge of at least one of the first, second, third and fourth side walls via at least one fold line, and closing said lower opening of the rectangular frame;

a first upper flap, continuous with an upper edge of the second side wall via a fold line, having at least one first supporting window and being folded into the rectangular frame to form a first article supporting section;

a second upper flap, continuous with an upper edge of the fourth side wall via a fold line, having at least one second supporting window and being folded into the rectangular frame to form a second article supporting section;

wherein said first article supporting section includes a first upper supporting portion, and said second article supporting section includes a second upper supporting portion which is disposed lower than said first upper supporting portion;

wherein said second article supporting section further includes an inner vertical wall spaced inwardly from said fourth side wall; and wherein, when the sheet is assembled into the rectangular frame, the at least one first supporting window of the first article supporting section and the at least one second supporting window of the second article supporting section are opposed to each other so that the article is supported with one side thereof inserted into the at least one first supporting window and the other side thereof inserted into the at least one second supporting window.

15. A container as recited in claim 14, further comprising a top wall, continuous with an upper edge of said second side wall via a fold line, openably closing an upper opening of said rectangular frame.

16. A container as recited in claim 14, wherein a first lower flap is provided and is continuous with a lower edge of the second side wall via a fold line;

a second lower flap is provided and is continuous with a lower edge of the fourth side wall via a fold line;

the first upper flap forming the first article supporting section comprises a first upper supporting portion extending horizontally on an inner side of the second side wall, a first supporting wall extending vertically and connecting an inner end of the first upper supporting portion and the first lower flap with each other, and a first bonding portion continuous with the first supporting wall and being fixed to the first lower flap with adhesive agent;

the second upper flap forming the second article supporting section comprises a second upper supporting portion extending horizontally on an inner side of the fourth side wall, a second supporting wall extending vertically and connecting an inner end of the second upper supporting portion and the second lower flap with each other, and a second bonding portion continuous with the second supporting wall and being fixed to the second lower flap with adhesive agent;

the at least one first supporting window is defined on the first supporting wall and the first upper supporting portion; and the at least one second supporting window is defined on the second supporting wall and the second supporting portion.

17. A container as recited in claim 14, wherein at least one holding projection is formed on each of said at least one first supporting window and said at least one second supporting window.

18. A container as recited in claim 14, wherein said at least one first supporting window comprises a plurality of parallel first supporting windows spaced apart from one another at regular intervals; and said at least one second supporting window comprises a plurality of parallel second supporting windows spaced apart from one another at regular intervals.

19. A container as recited in claim 14, wherein said first article supporting section has a first predetermined length extending inwardly from said rectangular frame, and said second article supporting section has a second predetermined length extending inwardly from said rectangular frame; and said first predetermined length is greater than said second predetermined length, such that said first article supporting section extends inwardly to approximately a longitudinal center of said frame.

20. A container as recited in claim 14, wherein said upper supporting portion is stepped downwardly from an upper edge of said fourth side wall, such that said upper supporting portion is vertically lower than the upper edge of said fourth side wall.

21. A container as recited in claim 14, wherein a first lower flap is provided and is continuous with a lower edge of the second side wall via a fold line;

a second lower flap is provided and is continuous with a lower edge of the fourth side wall via a fold line;

first, second, third, fourth and fifth fold lines, parallel with the upper edge of said fourth side wall, are formed at predetermined intervals on said second upper flap;

a region between the upper edge of said fourth side wall and said first fold line is folded inwardly to define said upper horizontal wall;

a region between said first fold line and said second fold line is folded downward in parallel with said fourth side wall to define said inner vertical wall;

a region between said second fold line and said third fold line is folded inwardly to define a horizontal bonding portion to be bonded to said second lower flap with adhesive agent;

a region between said third fold line and said fourth fold line is folded upward to define a supporting wall which is parallel with said fourth side wall;

a region between said fourth fold line and said fifth fold line is folded outwardly horizontally to define said second upper supporting portion; and a region between said fifth fold line and a distal end of said second upper flap is folded in parallel with said fourth side wall to define a bonding portion to be bonded to said inner vertical wall.

22. A container as recited in claim 14, wherein said second upper flap further comprises a supporting wall continuous with and said second upper supporting portion via a fold line, said at least one second supporting window being formed in said supporting wall and said upper supporting portion; and said second upper flap further comprises an outer wall having an entrance/exit formed therein, said outer wall being disposed outwardly of said supporting wall and said second upper supporting portion and being continuous with said supporting wall and said second upper supporting portion.

23. A container as recited in claim 14, wherein the article comprises a generally tubular syringe having, at one end thereof, a wing-shaped finger grip which comprises a rectangular flat portion with a shorter side having a length substantially the same as a diameter of the syringe and a longer side having a length greater than the diameter of the syringe; and said finger grip is inserted into said at least one second supporting window of said second article supporting section with the longer side of said finger grip disposed vertically and the upper end thereof projecting from said at least one second supporting window.

24. A container as recited in claim 23, wherein said at least one second window has a width which is greater than the length of said shorter side of said finger grip and is less than the length of said longer side of said finger grip.

25. A container as recited in claim 24, wherein said at least one second supporting window has a height which is approximately half of the length of said longer side of said finger grip.

* * * * *